US009476608B2

(12) United States Patent
Yang et al.

(10) Patent No.: US 9,476,608 B2
(45) Date of Patent: Oct. 25, 2016

(54) CEILING MOUNTED VENTILATION FAN WITH ILLUMINATION

(75) Inventors: Decong Yang, Foshan (CN); Qianhao Tan, Foshan (CN); Pingting Yang, Foshan (CN); Qiuqian Liang, Foshan (CN); Yannong Wu, Foshan (CN); Hitoshi Yoshikawa, Gifu (JP)

(73) Assignees: PANASONIC ECOLOGY SYSTEMS GUANGDONG CO., LTD., Guangdong (CN); PANASONIC CORPORATION, Osaka (JP)

( * ) Notice: Subject to any disclaimer, the term of this patent is extended or adjusted under 35 U.S.C. 154(b) by 619 days.

(21) Appl. No.: 13/982,915

(22) PCT Filed: Mar. 23, 2012

(86) PCT No.: PCT/CN2012/072911

§ 371 (c)(1),
(2), (4) Date: Jul. 31, 2013

(87) PCT Pub. No.: WO2012/146105

PCT Pub. Date: Nov. 1, 2012

(65) Prior Publication Data

US 2013/0315731 A1 Nov. 28, 2013

(30) Foreign Application Priority Data

Apr. 27, 2011 (CN) ..... 2011 1 0115127

(51) Int. Cl.
*F04D 25/08* (2006.01)
*F24F 13/078* (2006.01)
(Continued)

(52) U.S. Cl.
CPC ..... *F24F 13/078* (2013.01); *F04D 17/16* (2013.01); *F04D 25/088* (2013.01);
(Continued)

(58) Field of Classification Search
CPC ..... F04D 17/16; F04D 25/08; F04D 25/088; F04D 29/4226; F04D 29/661; F04D 29/601; F24F 13/078; F24F 7/065; F24F 2221/14; F21V 33/096
See application file for complete search history.

(56) References Cited

U.S. PATENT DOCUMENTS 1,722,825 A 7/1929 Roethel
2,189,008 A 2/1940 Kurth
(Continued)

FOREIGN PATENT DOCUMENTS

CN 101307770 11/2008
CN 101334204 12/2008
(Continued)

OTHER PUBLICATIONS

Chinese Office Action, dated May 4, 2014, in corresponding Chinese Patent Application No. 201180062492.1, along with an English translation thereof.
(Continued)

*Primary Examiner* — Ninh H Nguyen
(74) *Attorney, Agent, or Firm* — Greenblum & Bernstein P.L.C.

(57) ABSTRACT

The ceiling mounted ventilation fan with illumination employs a configuration in which a second opening for guiding light from an illumination unit into the room is formed in a lower part of a main housing and in which a air inlet on a fan casing of a fan unit is provided so as to open toward upper part of the main housing. Thus the air inlet of the fan unit opens in a direction opposite to the second opening communicating with inside of the room. As a result, sounds such as operation noises from the fan unit that are transmitted to outside of the fan unit chiefly through the air inlet can be made to resist being transmitted through the second opening into the room, so that the noises can be reduced.

18 Claims, 8 Drawing Sheets

(51) Int. Cl.

| | |
|---|---|
| ***F04D 29/42*** | (2006.01) |
| ***F04D 29/66*** | (2006.01) |
| ***F04D 29/60*** | (2006.01) |
| ***F21V 33/00*** | (2006.01) |
| ***F04D 17/16*** | (2006.01) |
| ***F24F 7/06*** | (2006.01) |
| *F24F 13/24* | (2006.01) |

(52) U.S. Cl.

CPC ..... *F04D 29/4226* (2013.01); *F04D 29/601* (2013.01); *F04D 29/661* (2013.01); *F21V 33/0096* (2013.01); *F24F 7/065* (2013.01); *F24F 13/24* (2013.01); *F24F 2221/14* (2013.01)

(56) References Cited

U.S. PATENT DOCUMENTS

| | | | | |
|---|---|---|---|---|
| 2,689,906 | A * | 9/1954 | Corbett | F24H 3/0411 219/213 |
| 3,068,341 | A | 12/1962 | Ortiz et al. | |
| 3,744,396 | A | 7/1973 | Raider | |
| 3,785,271 | A * | 1/1974 | Joy | F24F 13/078 219/220 |
| 4,142,227 | A * | 2/1979 | Aikens | B60H 1/3442 362/364 |
| 4,681,024 | A * | 7/1987 | Ivey | F24H 3/0411 219/220 |
| 5,934,783 | A * | 8/1999 | Yoshikawa | F21V 33/0096 362/149 |
| 7,175,309 | B2 | 2/2007 | Craw et al. | |
| 7,203,416 | B2 | 4/2007 | Craw et al. | |
| 7,455,432 | B2 | 11/2008 | Craw et al. | |
| 8,434,916 | B2 | 5/2013 | Craw et al. | |
| 9,103,104 | B1 * | 8/2015 | Tom | E03D 9/052 |
| 2005/0117341 | A1 | 6/2005 | Craw et al. | |
| 2009/0073702 | A1 | 3/2009 | Craw et al. | |
| 2010/0009621 | A1 | 1/2010 | Hsieh | |
| 2013/0266443 | A1 | 10/2013 | Yang et al. | |

FOREIGN PATENT DOCUMENTS

| | | |
|---|---|---|
| CN | 201173477 | 12/2008 |
| CN | 101737763 | 6/2010 |
| FR | 2887018 | 12/2006 |
| JP | 57-68426 | 4/1982 |
| JP | 2-275235 | 11/1990 |
| JP | 4-61235 | 5/1992 |
| JP | 5-118606 | 5/1993 |
| JP | 2006-258363 | 9/2006 |

OTHER PUBLICATIONS

International Search Report, for PCT/CN2012/072911, dated Nov. 8, 2012.

International Search Report, for PCT/CN2011/080333, dated Dec. 22, 2011.

Office Action from JPO, for JP2012-551493, dated Dec. 18, 2012, with an English language translation thereof.

NuTone (QT-9093 Series—Mar. 2004).

NuTone (QT-200 Series—Mar. 2004).

U.S. Appl. No. 13/982,915 (Yang et al.), filed Jul. 31, 2013.

Notification of Reasons for Refusal in JP2013-090857, dated May 28, 2013 and an English language translation thereof.

Office Action dated Jan. 3, 2014 in related U.S. Appl. No. 13/992,881.

* cited by examiner

CEILING MOUNTED VENTILATION FAN WITH ILLUMINATION

TECHNICAL FIELD

The present invention relates to a ventilation fan for push-pull ventilation system (i.e., a ventilation fan for air supply and exhaust systems) and, more particularly, to a noise reduction structure of a ceiling mounted ventilation fan with illumination for push-pull ventilation system.

BACKGROUND ART

As such a type of ceiling mounted ventilation structure with illumination, there has conventionally been known a structure with use of downlight, for instance. FIG. 8 shows an example of a conventional ceiling mounted ventilation structure with illumination (see Patent Document 1, for instance).

As shown in FIG. 8, the conventional ceiling mounted ventilation structure 108 with illumination has a recessed portion (dent portion) 102 provided on a ceiling 101, an electric bulb 105 that is enclosed by a moisture-proof cover 104 and that is placed in the recessed portion 102 with a rubber packing 103 therebetween, a ventilation opening 106 formed on a part of a peripheral wall of the recessed portion 102, and a duct 107 connected to the ventilation opening 106.

The ceiling mounted ventilation structure 108 with illumination is capable of attaining the function of room ventilation while attaining the function as downlight.

PATENT DOCUMENT

Patent Document 1: JP S57-68426 U

SUMMARY OF INVENTION

Technical Problem

In the conventional ceiling mounted ventilation structure 108 with illumination is employed a structure in which the recessed portion 102 is formed in shape of a circular truncated conical cylinder and in which an inner wall surface of the recessed portion 102 is used as a reflecting surface so as to reflect light from the electric bulb 105 toward underside, that is, toward inside of a room. The employment of such a structure enhances the function of downlight in the ceiling mounted ventilation structure 108 with illumination.

The formation of the recessed portion 102 in the shape of the circular truncated conical cylinder, however, causes a problem in that the shape functions as so-called megaphone by which air blow noises made in the ceiling mounted ventilation structure 108 with illumination and operation noises from a fan or the like may be transmitted to the inside of the room or to farther sites with enhancement of directivity of such noises.

Accordingly, an object of the present invention, lying in solving the above-described issues, is to provide a ceiling mounted ventilation fan with illumination capable of suppressing noise conducted to room inside.

Solution to Problem

In order to achieve the object, the invention is configured as follows.

According to a first aspect of the invention, there is provided a ceiling mounted ventilation fan with illumination comprising a main housing, and a fan unit and lighting equipment installed in the main housing, the main housing comprising:

a first opening connected to an air outlet of the fan unit, the first opening communicating with a duct, and a second opening formed in a lower part of the main housing so as to communicate with inside of a room, the lighting equipment comprising:

an illumination unit, and a lighting cover placed in the main housing so as to surround the illumination unit, the lighting cover having a reflecting surface which reflects light from the illumination unit so as to guide the light through the second opening into the room, the fan unit comprising:

a fan, and a fan casing placed so as to surround the fan, the fan casing having an air inlet opening toward upper part of the main housing, wherein air introduced through the second opening into the main housing is sucked through the air inlet of the fan casing into the fan unit and is discharged by the fan unit through the first opening into the duct.

According to a second aspect of the invention, there is provided a ceiling mounted ventilation fan with illumination according to the first aspect, wherein an electrical unit for the fan unit or the lighting equipment is placed on an area facing the second opening, on an inner wall surface of the upper part of the main housing, and the fan unit is placed in the main housing so that a distance L1 from the inner wall surface of the upper part of the main housing to the air inlet of the fan casing is greater than a height L2 of the electrical unit.

According to a third aspect of the invention, there is provided a ceiling mounted ventilation fan with illumination according to the second aspect, further comprising leg parts that support the fan casing on an inner wall surface of the lower part of the main housing, wherein the fan unit is movable between a placement position for the fan unit in the main housing and a maintenance position for the fan unit over the second opening by slide movement of the leg parts along the inner wall surface of the lower part of the main housing.

According to a fourth aspect of the invention, there is provided a ceiling mounted ventilation fan with illumination according to the third aspect, further comprising guiding members that are engaged with the leg parts so as to guide the slide movement of the leg parts.

Effects of Invention

According to the invention, the ceiling mounted ventilation fan with illumination employs the configuration in which the second opening for guiding the light from the illumination unit into the room is formed in the lower part of the main housing and in which the air inlet on the fan casing of the fan unit is provided so as to open toward the upper part of the main housing. Thus the air inlet of the fan unit opens in the direction opposite to the second opening communicating with the inside of the room. Accordingly, sounds such as operation noises from the fan unit that are transmitted to the outside of the fan unit chiefly through the air inlet can be made to resist being transmitted through the second opening into the room. As a result, the ceiling mounted ventilation fan with illumination can be provided by which the noise conducted to room inside is suppressed.

DESCRIPTION OF EMBODIMENTS

Figure 1:
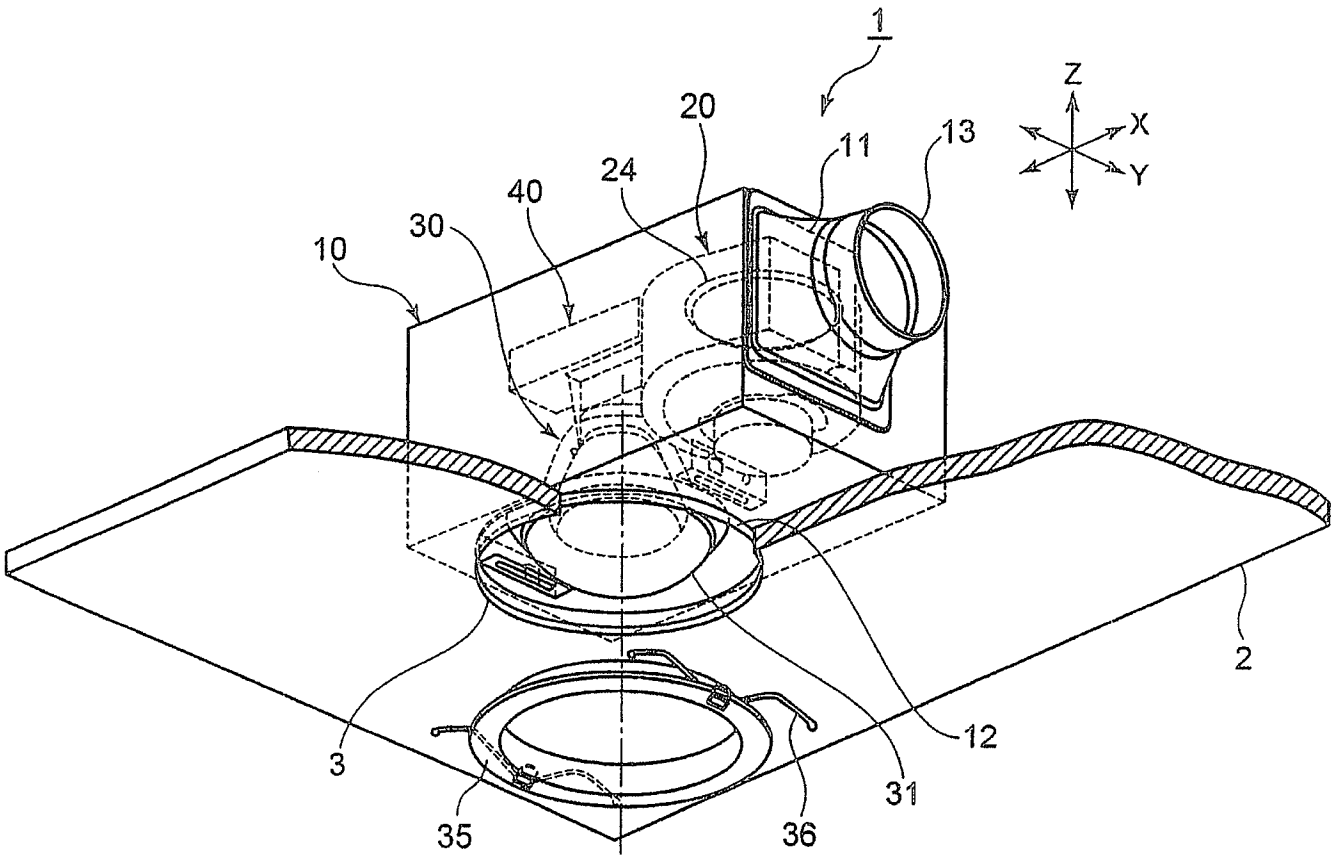
FIG. 1 is a perspective view of a ceiling mounted ventilation fan with illumination in accordance with an embodiment 1 of the invention.

Before the description of the present invention proceeds, it is to be noted that like parts are designated by like reference numerals throughout the accompanying drawings. Hereinbelow, embodiments of the present invention will be described in detail with reference to the accompanying drawings.

Embodiment 1

Figure 2:
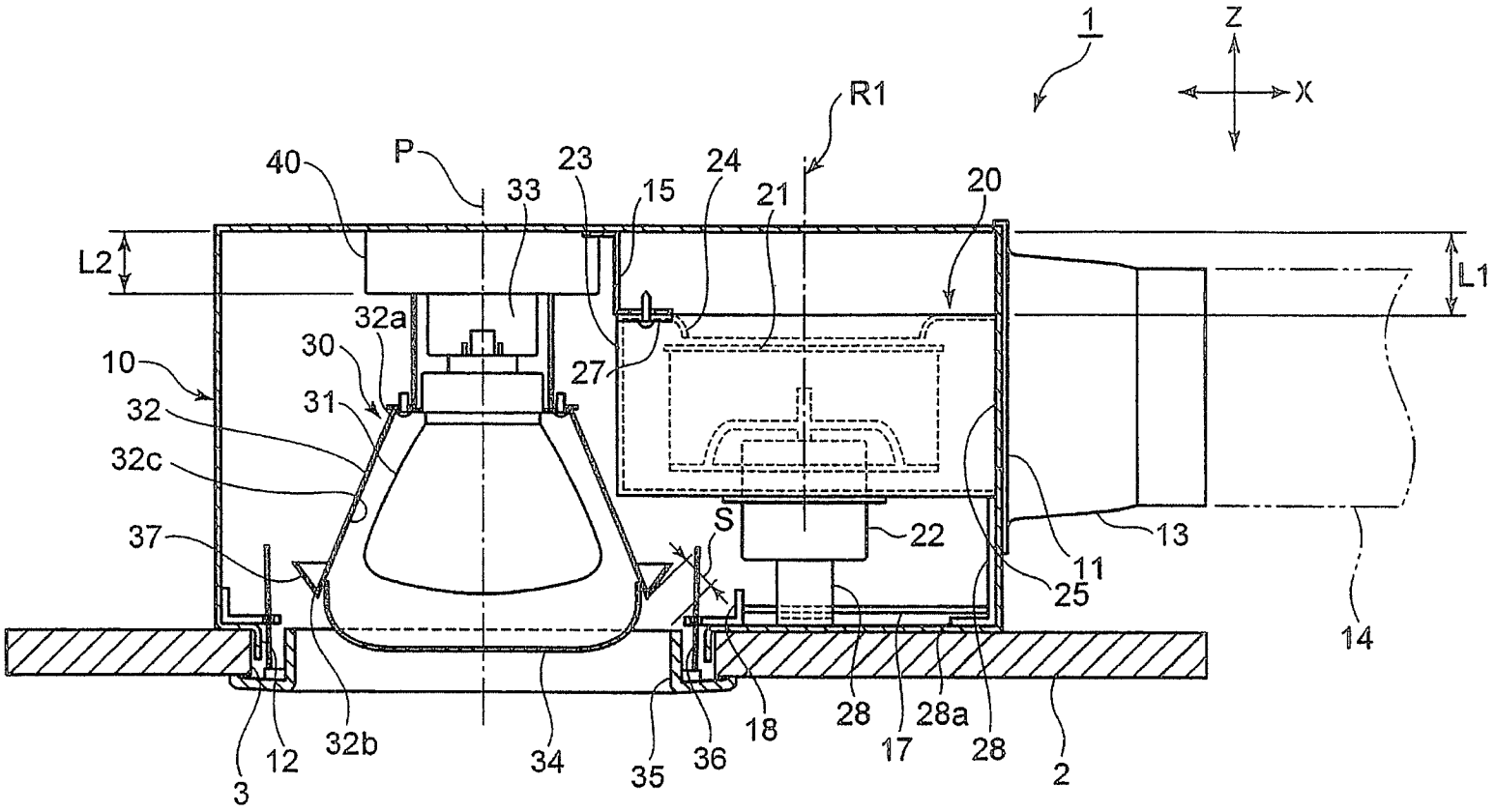
FIG. 2 is a sectional view of the ceiling mounted ventilation fan with illumination of the embodiment 1 as seen looking from a Y direction.
Figure 3:
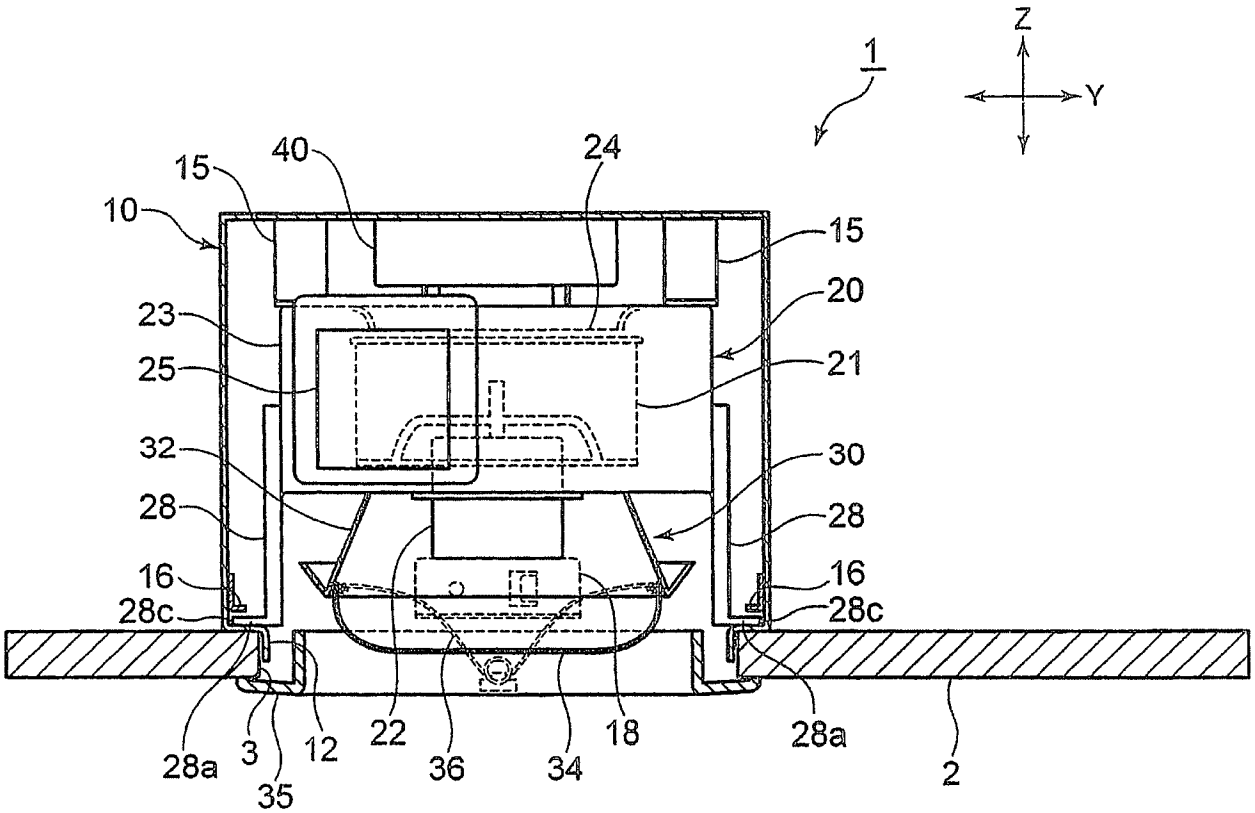
FIG. 3 is a sectional view of the ceiling mounted ventilation fan with illumination of the embodiment 1 as seen looking from an X direction.

FIG. 1 shows a perspective view of a ceiling mounted ventilation fan 1 with illumination in accordance with an embodiment 1 of the invention. FIG. 2 shows a sectional view (partly sectional view) thereof as seen looking from a Y direction in FIG. 1. FIG. 3 shows a sectional view (partly sectional view) thereof as seen looking from an X direction in FIG. 1. In FIG. 1, the X direction and the Y direction are horizontal directions that are orthogonal to each other and a Z direction is a vertical direction that is orthogonal to the X direction and to the Y direction.

As shown in FIGS. 1, 2 and 3, the ceiling mounted ventilation fan 1 with illumination includes a main housing 10 that is generally shaped like a box, and a fan unit 20 and lighting equipment 30 that are placed in the main housing 10.

The main housing 10 has a first opening 11 connected to an air outlet of the fan unit 20 and a second opening 12 communicating with inside of a room through a ceiling opening 3 formed on a ceiling 2. The first opening 11 formed on a side part of the main housing 10 is connected to a duct connection part 13 so as to communicate with a duct 14 through the duct connection part 13. Though FIGS. 1 and 2 show an example in which the first opening 11 is formed on the side part of the main housing 10 and in which the second opening 12 is formed in a lower part of the main housing 10, the first opening 11 may be formed on upper part of the main housing 10.

The fan unit 20 has a fan 21, a motor 22 for rotating the fan 21, and a fan casing 23 that is placed so as to surround the fan 21. The fan unit 20 is fixed to an inner wall of the upper part of the main housing 10. On the fan casing 23 of the fan unit 20 is formed an air inlet 24 that opens toward an inner wall surface of the upper part of the main housing 10 (that is, the air inlet 24 is provided so as to open upward in the drawing). Air in the main housing 10 is taken into the fan casing 23 through the air inlet 24 opening upward and is thereafter discharged through the air outlet of the fan casing 23, the first opening 11 and the duct connection part 13 into the duct 14. Though a centrifugal fan unit such as a multi-blade fan will be described below as an example of type of the fan unit 20, there may be employed other types of fan units that are capable of attaining such a function of discharge. A detailed structure of the fan unit 20 will be described later.

The lighting equipment 30 includes a lamp (illumination unit) 31, a lighting cover 32 that surrounds the lamp 31, and a lamp mounting fixture 33 for detachably fixing the lamp 31 and the lighting cover 32 onto the inner wall of the main housing 10. The lamp 31 and the lighting cover 32 are placed on a central axis P so that center positions thereof substantially coincide with a center of the second opening 12 of the main housing 10 as seen looking in a vertical direction. In addition to a function of detachably fixing the lamp 31, the lamp mounting fixture 33 has a function of supplying the lamp 31 with electricity. As the lamp 31, a fluorescent lamp or an LED may be used in place of the so-called electric bulb. A relation of placement between the lamp 31, the lighting cover 32 and the second opening 12 of the main housing 10 is not limited to such a relation that the center positions of those substantially coincide with one another as seen looking in the vertical direction. The relation of placement has only to be such that light from the lamp 31 is cast into the room through the second opening 12.

The lighting cover 32 is generally formed in shape of a circular truncated conical cylinder so that a diameter of a lower end 32*b* of the cover 32 is greater than that of an upper end 32*a* thereof. The lighting cover 32 is formed so as to have a length (size in the vertical direction) that covers an overall surrounding side part of a light emitting part of the lamp 31 provided inside the cover 32. Between the lighting cover 32 and the lamp 31 is secured such a gap as prevents contact therebetween.

An inner circumferential surface of the lighting cover 32 forms a reflecting surface 32*c* that reflects the light from the lamp 31 toward the second opening 12 (i.e., downward). The lighting cover 32 having such a reflecting surface 32*c* makes it possible for the light from the lamp 31 to make into direct light and reflected light and to efficiently irradiate the inside of the room.

The lighting equipment 30 includes a lid (lid member) 34 for sealing an opening of the lower end 32*b* of the lighting cover 32. The lid 34 is detachably attached to the lower end 32*b* of the lighting cover 32 so as not to be in contact with the lamp 31. The lid 34 is detached from the lighting cover 32 on occasion of replacement of the lamp 31 and the like.

Onto the inner wall surface of the upper part of the main housing 10 above the lamp mounting fixture 33 of the lighting equipment 30, an electrical unit 40 is fixed that contains various electrical components for energizing the fan unit 20 and the lighting equipment 30 or controlling operations thereof. The motor 22 of the fan unit 20 and the lamp mounting fixture 33 of the lighting equipment 30 are electrically connected to the electrical unit 40. The lamp mounting fixture 33 is detachably fixed through the electrical unit 40 onto the inner wall surface of the upper part of the main housing 10.

A flange 35 (opening member) that is an annular member is mounted on the ceiling opening 3. The flange 35 serves as a dressing member that covers a lower periphery and an inner circumferential surface of the ceiling opening 3 so as to prevent the ceiling opening 3 from being directly seen from the inside of the room. The flange 35 is attached with the lower periphery of the ceiling opening 3 biased upward through biasing members (such as wire-like springs) 36 that each have one end engaged with the main housing 10 and the other end engaged with the flange 35. When the flange 35 is released from the ceiling opening 3, the biasing members 36 prevent the flange 35 from falling down. FIG. 1 shows a state in which the flange 35 has been released from the ceiling opening 3.

As shown in FIG. 2, an annular gap S for air intake is provided between the lower end 32*b* of the lighting cover 32 and an edge part of the second opening 12 of the main housing 10, more particularly, an inside edge part of the flange 35. An introduction path for indoor air is formed so that the indoor air introduced through the ceiling opening 3 on which the flange 35 is placed is then introduced through the annular gap S for air intake and the second opening 12 into the main housing 10.

On the lower end 32*b* of the lighting cover 32 is formed an annular brim 37 that is formed so as to protrude toward surroundings thereof.

Once the lamp 31 is turned on in the ceiling mounted ventilation fan 1 with illumination that has such a configuration, the light from the lamp 31 is introduced through the lid 34 and the ceiling opening 3 (opening of the flange 35) into the room and light from a circumferential surface of the side part of the lamp 31 is reflected downward by the reflecting surface 32*c* of the lighting cover 32 and is subsequently introduced through the lid 34 and the ceiling opening 3 into the room. Thus the ceiling mounted ventilation fan 1 with illumination functions as a downlight.

When the fan 21 is rotated by the motor 22 of the fan unit 20, the indoor air is introduced through the ceiling opening 3 and the annular gap S for air intake into the main housing 10. In the annular gap S for air intake, wind noises produced by the lower end 32*b* of the lighting cover 32 and the like are reduced by the annular brim 37 formed on the lower end 32*b* of the lighting cover 32. The air introduced into the main housing 10 is taken into the fan casing 23 through the air inlet 24 opening upward and is discharged from the fan unit 20 through the first opening 11 and the duct connection part 13 into the duct 14. Thus the ceiling mounted ventilation fan 1 with illumination functions as a ventilation fan.

Figure 4:
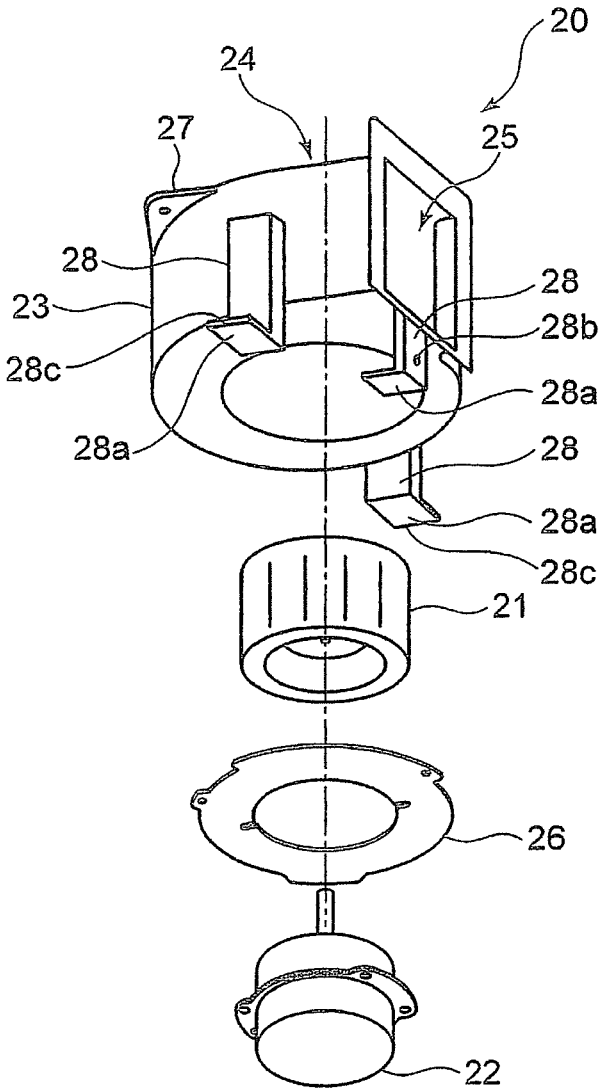
FIG. 4 is an exploded view of a fan unit of the ceiling mounted ventilation fan with illumination of the embodiment 1.

With reference to FIG. 4 that is an exploded view of the fan unit 20, hereinbelow, the detailed structure of the fan unit 20 will be described later.

As shown in FIG. 4, the fan unit 20 includes the fan 21, the motor 22 for rotating the fan 21, and the fan casing 23 that is placed so as to surround the fan 21. The fan casing 23 has a so-called voluted shape. An opening is formed on a center of each of top and bottom surfaces thereof and the air outlet 25 is formed on a side surface thereof that is a terminal part of the voluted shape. The opening at the center of the bottom surface of the fan casing 23 is sealed by attachment of the motor 22 through a sealing member 26 in shape of a disc. The opening at the center of the top surface of the fan casing 23 forms the air inlet 24.

On an edge of the top surface of the fan casing 23 are formed two mounting parts 27 protruding outward along the upper surface. As shown in FIGS. 2 and 3, the mounting parts 27 are screwed onto mounting members 15 fixed to the inner wall surface of the upper part of the main housing 10, and the fan unit 20 is thereby detachably fixed to the main housing 10.

As shown in FIG. 4, three leg parts 28 extending downward are provided on the side surface of the fan casing 23. As shown in FIGS. 2 and 3, the leg parts 28 each have a lower end 28*a* shaped like a letter L. Each lower end 28*a* is placed on an inner wall surface of the lower part of the main housing 10 and thus supports the fan unit 20 on the inner wall surface of the lower part. In the embodiment 1, the lower ends 28*a* of the leg parts 28 are not fixed to the lower part of the main housing 10 but only support the fan unit 20. Consequently, the fan unit 20 can be slid in the X direction in a state in which the fixation between the mounting parts 27 and the mounting members 15 has been released, as will be described later.

As shown in FIG. 3, the lower ends 28*a* of the leg parts 28, on left and right sides in the drawing, of the fan unit 20 are each shaped like a letter L so as to extend outward in the Y direction, and extremity sides 28*c* of the lower ends 28*a* are formed so as to extend in parallel with the X direction. Guiding parts 16 that are to be engaged with the lower ends 28*a* of the leg parts 28 on the left and right sides in the drawing are formed on inner wall surfaces of side parts of the main housing 10 that face each other. The guiding parts 16 are formed so as to extend in the X direction in the drawing. With the guiding parts 16 engaged with the lower ends 28*a* of the leg parts 28 on the left and right sides in the drawing, the extremity sides 28*c* of the lower ends 28*a* are guided, so that slide movement of the leg parts 28 in the X direction is thereby guided. The guiding parts 16, however, may be omitted.

As shown in FIG. 2, a guiding bar 17 extending in the X direction is provided on the inner wall surface of the lower part of the main housing 10. One end of the guiding bar 17 is fixed to the inner wall surface of the side part of the main housing 10 and the other end thereof is fixed to a stopper 18 fixed onto the inner wall surface of the lower part. A hole 28*b* is formed on the leg part 28 at center of the fan unit 20 (see FIG. 4). The guiding bar 17 is inserted into the hole 28*b*. Thus the slide movement of the leg part 28 at the center in the X direction is guided by the guiding bar 17 and a range of the slide movement of the leg part 28 in the X direction is restricted to between both the ends of the guiding bar 17.

FIG. 2 shows a state in which the fan unit 20 is placed in a placement position R1 where the fan unit 20 is connected through the first opening 11 to the duct connection part 13, in which the fan unit 20 is supported by the leg parts 28, and in which the mounting parts 27 and the mounting members 15 are fixed to each other. A relation of placement between the fan unit 20 and the electrical unit 40 in a direction of height is set so that a distance L1 from the inner wall surface of the upper part of the main housing 10 to the air inlet 24 of the fan casing 23 is greater than a height L2 of the electrical unit 40 fixed onto the inner wall surface of the upper part of the main housing 10 in such a state.

Hereinbelow will be described procedures of maintenance for the motor 22 of the fan unit 20 in the ceiling mounted ventilation fan 1 with illumination having such a configuration.

As shown in FIG. 1, initially, the flange 35 is detached along with the biasing members 36 from the main housing 10. Subsequently, the lighting equipment 30 is detached from the main housing 10 by release of the lamp mounting fixture 33 from the main housing 10 and is then taken out through the second opening 12 into the room.

After that, the screw fixation between the mounting parts 27 of the fan casing 23 and the mounting members 15 is released. With the release from the fixation between the mounting parts 27 and the mounting members 15, the fan unit 20 is supported only by the three leg parts 28 from the underside.

Figure 5:
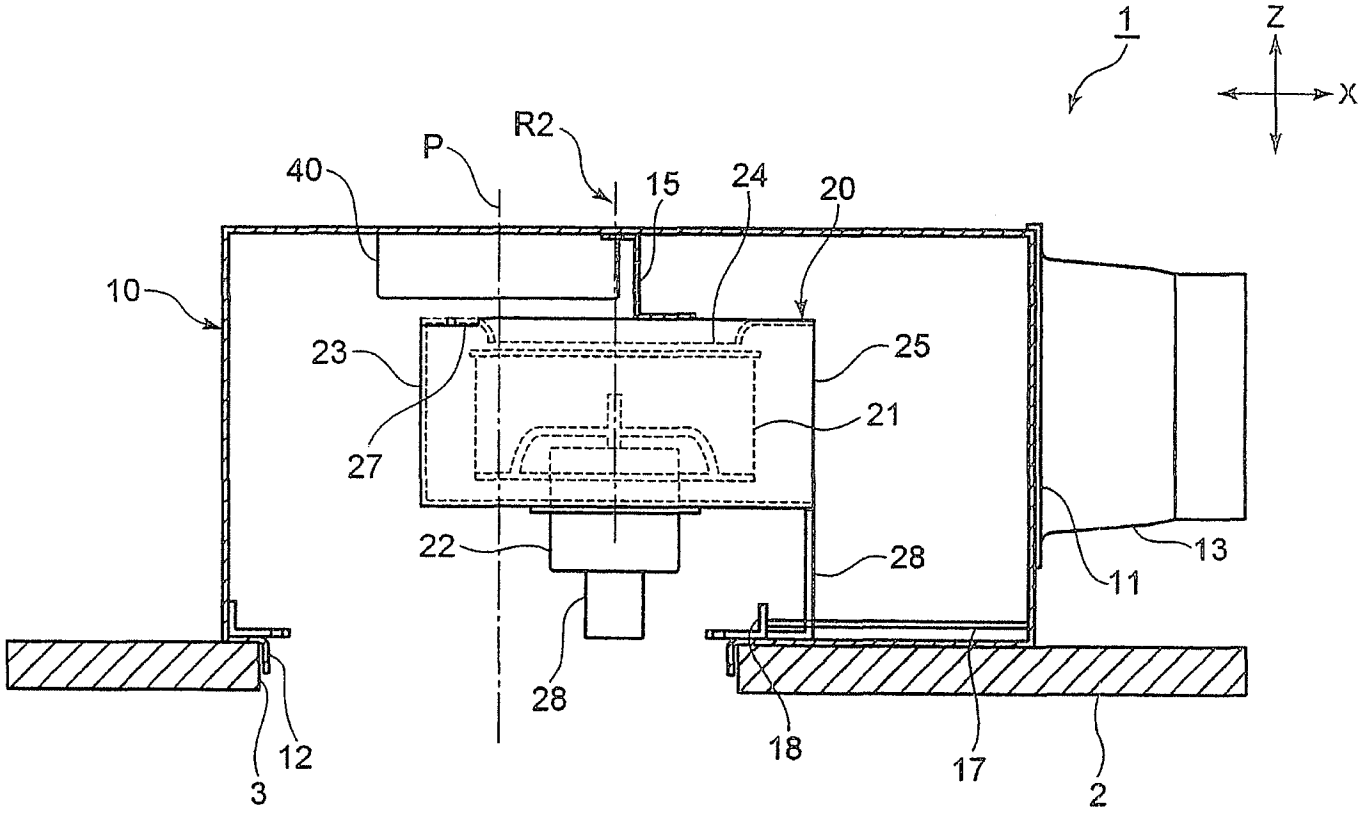
FIG. 5 is a sectional view of the ceiling mounted ventilation fan with illumination of the embodiment 1 as seen looking from the Y direction with the fan unit moved to a maintenance position.

Subsequently, the fan unit 20 placed in the placement position R1 is slid in the X direction so as to be placed in a maintenance position R2 that is over the second opening 12 (see FIG. 5). In the slide movement of the fan unit 20, as shown in FIG. 3, the lower ends 28*a* of the leg parts 28 on the left and right sides in the drawing are guided by the guiding parts 16 and the leg part 28 at the center is guided by the guiding bar 17. Therefore, the slide movement of the fan unit 20 can smoothly be performed. As shown in FIG. 5, the range of the slide movement of the fan unit 20 is restricted by contact of the lower end 28*a* of the leg part 28 at the center with the stopper 18, and the fan unit 20 is placed in the maintenance position R2 in a state with the contact. Thus positioning in the maintenance position R2 can easily be performed and excessive slide movement beyond the maintenance position R2 can be prevented. Interference between the fan unit 20 and the electrical unit 40 is prevented when the fan unit 20 is moved to the maintenance position R2, because the height L2 of the electrical unit 40 fixed onto the inner wall surface over the second opening 12 in the main housing 10 is set so as to be smaller than the distance L1 from the inner wall surface of the upper part of the main housing 10 to the air inlet 24 of the fan unit 20.

After that, maintenance operations, such as detachment of the motor 22, for the fan unit 20 placed in the maintenance position R2 are performed through the second opening 12. Once the maintenance operations are completed, the fan unit 20 is slid from the maintenance position R2 to the placement position R1. For the slide movement also, the guidance for the slide movement of every leg part 28 smoothes the movement and facilitates the positioning of the fan unit 20 in the placement position R1. After that, the screw fixation of the fan unit 20, attachment operations for the lighting equipment 30, and the like are performed.

In the embodiment 1, the ceiling mounted ventilation fan 1 with illumination employs the configuration in which the second opening 12 for guiding the light from the lamp 31 into the room is formed in the lower part of the main housing 10, and the fan casing 23 of the fan unit 20 employs the configuration in which the air inlet 24 is provided so as to open toward the upper part of the main housing 10. The bottom surface side of the fan casing 23 of the fan unit 20 is sealed by the attachment of the motor 22 through the sealing member 26 to the bottom surface side of the fan casing 23. Thus the air inlet 24 of the fan unit 20 opens in a direction opposite to the second opening 12 communicating with the inside of the room. As a result, sounds such as operation noises from the fan unit 20 (air blow noises, operation noises from the motor 22, and the like) that are transmitted to the outside of the fan unit 20 chiefly through the air inlet 24 can be made to resist being transmitted toward the second opening 12 in the main housing 10. Consequently, the ceiling mounted ventilation fan with illumination can be provided by which sounds such as operation noises from the fan unit 20 can be made to resist being transmitted through the second opening 12 into the room so that the noises that are transmitted into the room can be reduced.

Maintenance property for the fan unit 20 can be improved by the employment of the configuration in which the fan unit 20 can be slid between the placement position R1 and the maintenance position R2 in the main housing 10. By the provision of the members for guiding the slide movement of the fan unit 20, the slide movement can be smoothed and property of the positioning of the fan unit 20 in the placement position R1 and the maintenance position R2 can be improved.

The noises can further be reduced by such a contrivance for a structure of the lighting equipment 30 as in the embodiment 1 in addition to the noise reduction effect attained by such placement and configuration of the air inlet 24 of the fan unit 20.

In the embodiment 1, specifically, the lighting cover 32 that is placed so as to surround the lamp 31 has the cylindrical lower end 32*b* sealed with the lid 34. Thus passage of air through between the lamp 31 and the lighting cover 32 is restricted. This reduces propagation into the room of air blow noises caused by operation of the fan unit 20 placed in the main housing 10, operation noises from the motor 22 and the like with enhancement of directivity thereof that is caused by the lighting cover 32 that is generally in shape of the circular truncated conical cylinder and that functions as a megaphone. In particular, the lighting cover 32 is often generally shaped like the circular truncated conical cylinder because the cover 32 is required to have the reflecting surface 32*c* for the light from the lamp 31. There is a high possibility that the lighting cover 32 with such a shape functions as a so-called megaphone. The provision in the lighting cover 32 of the lid 34 that restricts the passage of air effectively reduces the propagation into the room of the sounds produced in the main housing 10 with enhancement of directivity thereof.

Though an example provided with the lid 34 for sealing the lower end 32*b* of the lighting cover 32 has been described above, the invention is not limited only to such a configuration. Provision of members (restriction members) capable of restricting the passage of air through between the lighting cover 32 and the lamp 31 ensures the same effect as that of the provision of the lid 34. For instance, restriction members that seal the upper end 32*a* may be provided in the lighting cover 32 with the lower end 32*b* opened. Alternatively, restriction members that seal the lower end 32*b* of the lighting cover 32 may be provided, with the upper end 32*a* opened. There may be provided both the restriction members that seal the upper end 32*a* of the lighting cover 32 and the restriction members that seal the lower end 32*b* thereof.

Such restriction members have only to have a configuration in which a function of restricting the passage of air through between the lighting cover 32 and the lamp 31 is attained. The configuration is not limited only to a configuration that completely shuts off the passage of air, and the passage of air has only to be restricted in general. For instance, the passage of air has only to be restricted in general even if openings required for the attachment of the lamp 31, power supply and/or the like are provided in the restriction members.

The lighting cover 32 may be generally shaped like a polygonal truncated prismoidal cylinder, a hemisphere or the like, other than the circular truncated conical cylinder. The restriction members may integrally be formed with the lighting cover 32.

The annular gap S for air intake has only to be formed around the lower end 32*b* of the lighting cover 32 and has only to be formed between the lower end 32*b* of the lighting cover 32 and the flange 35, between the lower end 32*b* and the second opening 12, or between the lower end 32*b* and the ceiling opening 3.

Sizes (area) of the annular gap S for air intake have only to be determined in design in consideration of specifications (air flow, static pressure and the like) of the fan unit 20, sizes of the lamp 31 and the lighting cover 32, a size of the ceiling opening 3, and the like.

Embodiment 2

Figure 6:
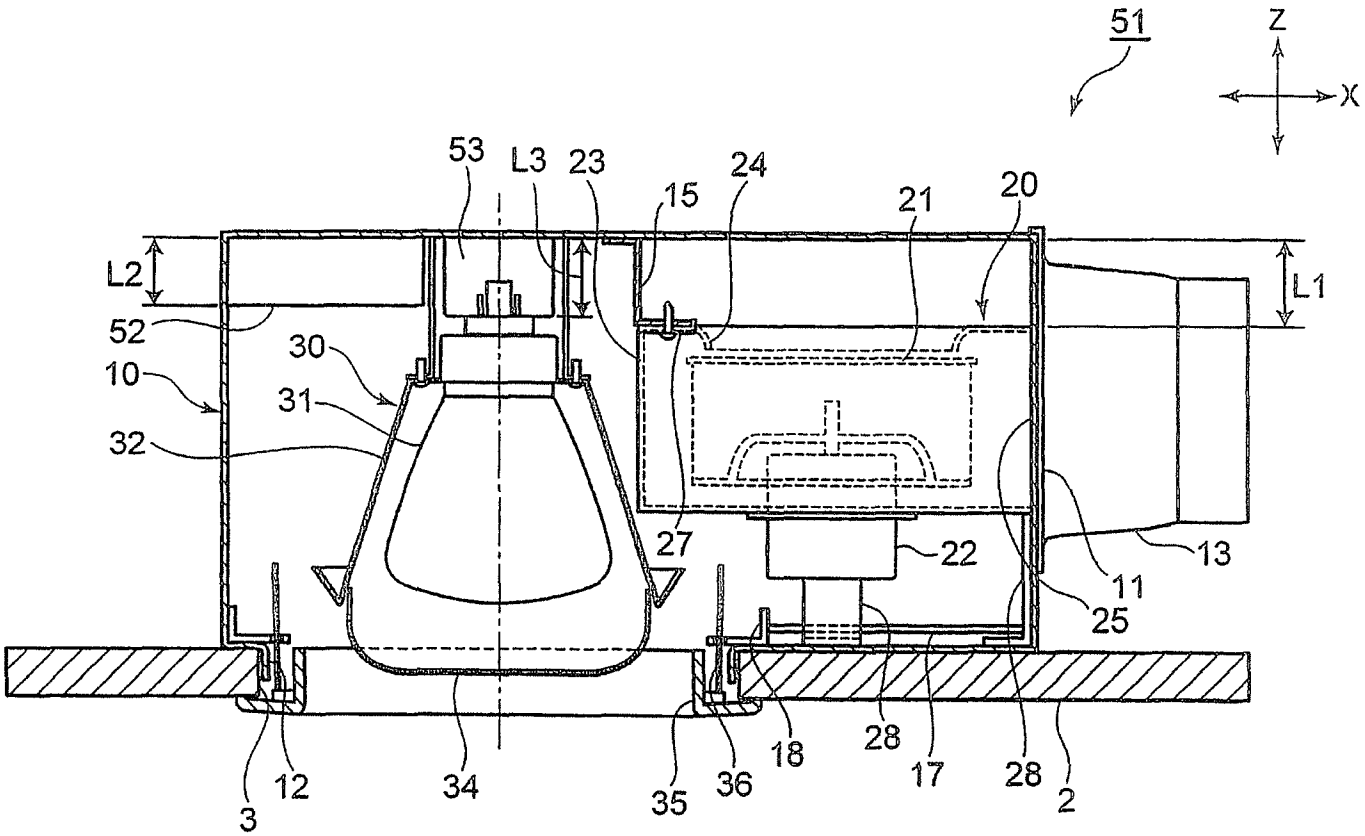
FIG. 6 is a sectional view of a ceiling mounted ventilation fan with illumination in accordance with an embodiment 2 of the invention.

The invention is not limited to the embodiment described above and can be embodied in other various manners. For instance, FIG. 6 shows a configuration of a ceiling mounted ventilation fan 51 with illumination in accordance with an embodiment 2 of the invention. The same component members as those of the ceiling mounted ventilation fan 1 with illumination of the embodiment 1 are designated by the same reference numerals, and description thereof is omitted.

The ceiling mounted ventilation fan 51 with illumination of the embodiment 2 shown in FIG. 6 is different from the embodiment 1 described above in that an electrical unit 52 is mounted on the inner wall surface of the upper part of the main housing 10 so as to avoid interference with a lamp mounting fixture 53 in the main housing 10. A relation between a height L2 of the electrical unit 52 and the distance L1 from the inner wall surface of the upper part of the main housing 10 to the air inlet 24 of the fan unit 20 is set so as to be L2<L1 as in the embodiment 1. A height L3 of the lamp mounting fixture 53 is set so that a relation L3<L1 holds.

In the embodiment 2, the noise reduction effect for the fan unit 20 can be obtained as in the embodiment 1 and the maintenance property for the fan unit 20 can be improved because interference between the fan unit 20 and the electrical unit 52 can be prevented in the maintenance position. There is another advantage therein in that the lighting equipment having a comparatively great height can be provided therein because the electrical unit 52 is placed so as to avoid the interference with the lamp mounting fixture 53.

Embodiment 3

Figure 7:
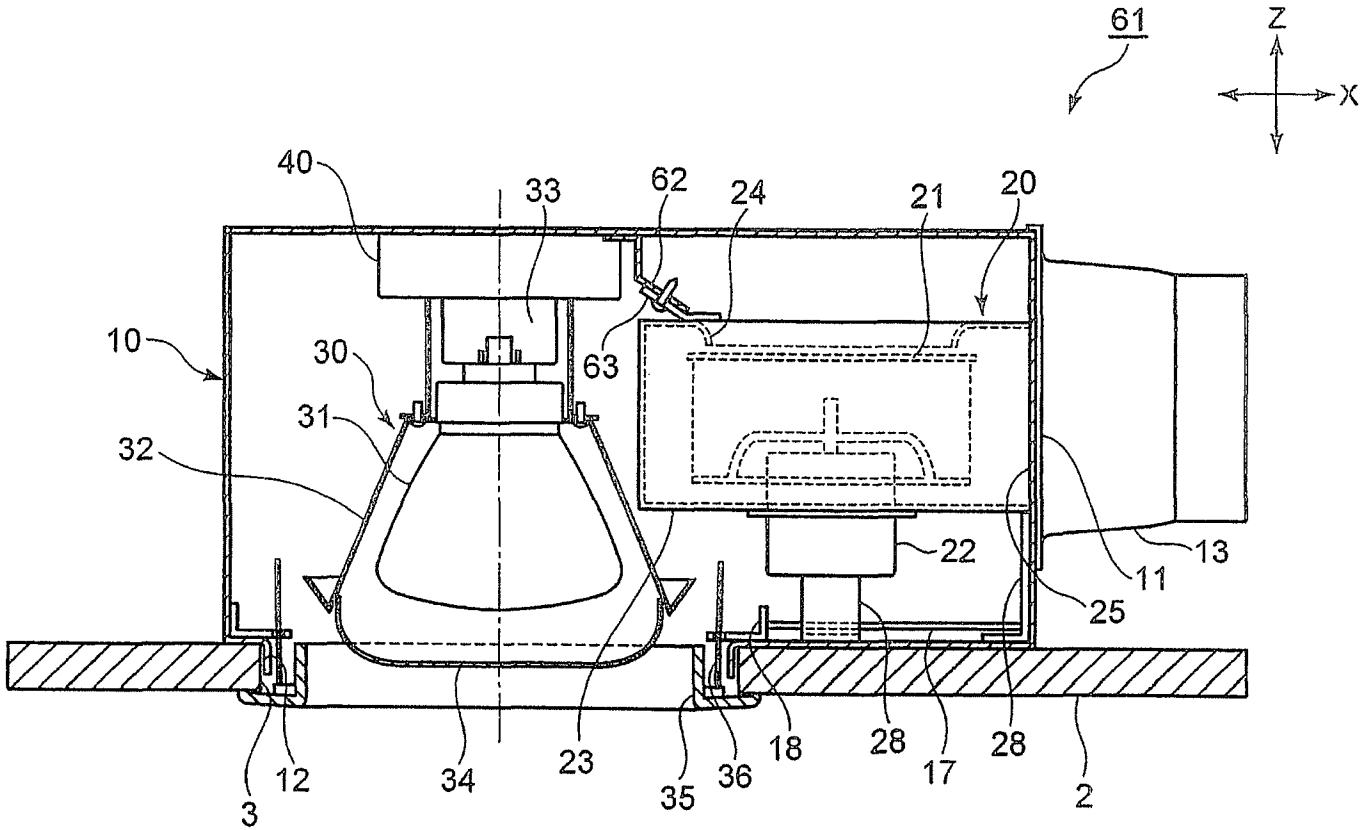
FIG. 7 is a sectional view of a ceiling mounted ventilation fan with illumination in accordance with an embodiment 3 of the invention.
Figure 8:
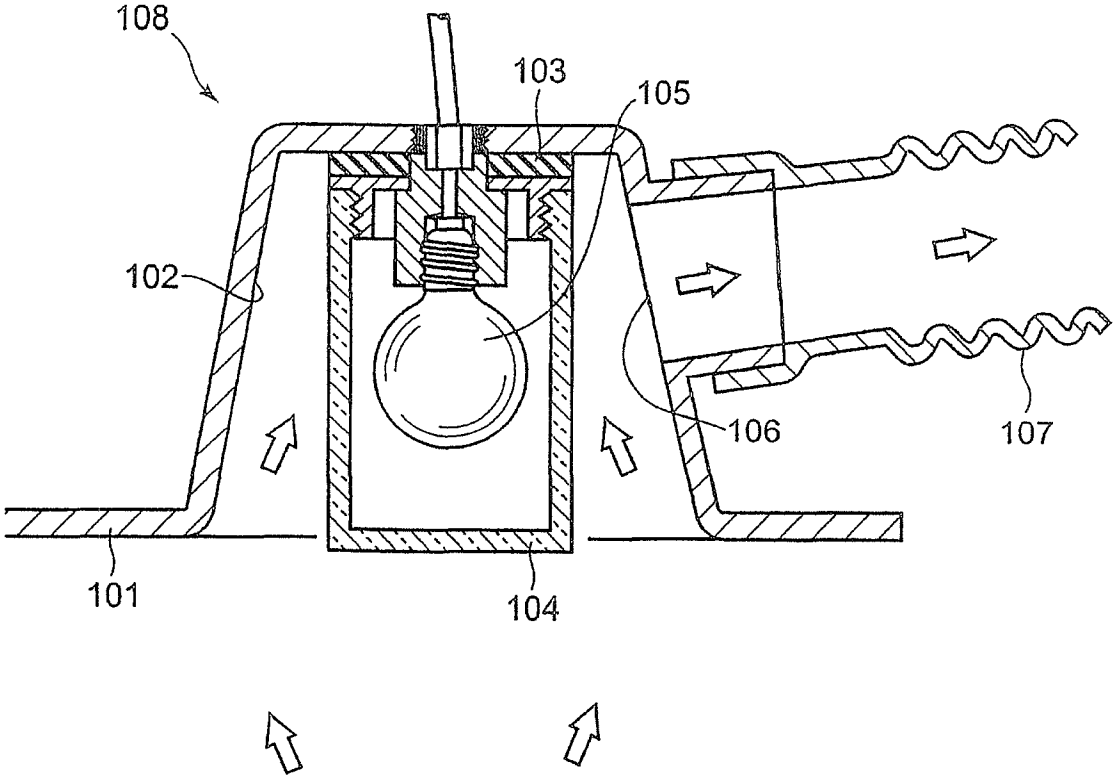
FIG. 8 is a sectional view showing a conventional ceiling mounted ventilation structure with illumination.

FIG. 7 shows a configuration of a ceiling mounted ventilation fan 61 with illumination in accordance with an embodiment 3 of the invention. In the ceiling mounted ventilation fan 61 with illumination of the embodiment 3 shown in FIG. 7, a configuration is employed in which a mounting member 62 for fixing the fan unit 20 onto the inner wall surface of the upper part of the main housing 10 and a mounting part 63 of the fan casing 23 are fixed in an inclined state by a screw. As shown in FIG. 7, specifically, the mounting part 63 and the mounting member 62 are inclined so that an axial direction of the screw that fixes the mounting part 63 to the mounting member 62 is generally oriented toward a center of the second opening 12.

Such a configuration improves visibility and working property (working property in the screw fixation with use of a screwdriver or the like) through the second opening 12 for the screw that fixes the mounting part 63 to the mounting member 62 and thus improves working property in maintenance for the fan unit 20.

Though examples with use of the lighting equipment 30 having a configuration in which the lower end 32*b* of the lighting cover 32 is sealed with the lid 34 have been described for the above embodiments 1 through 3, the form of the lighting equipment is not limited in the invention. Even if lighting equipment having a configuration in which upper and lower ends of the lighting cover are opened is used, noises that are transmitted into the room can be reduced by the upward placement of the air inlet 24 of the fan unit 20.

Working Example 1

For the ceiling mounted ventilation fan 1 with illumination of the embodiment 1, noises during the operation were measured in the configuration (working example) in which the air inlet 24 of the fan unit 20 was opened toward the inner wall surface of the upper part of the main housing 10 (i.e., opened upward) and the configuration (comparative example) in which the air inlet of the fan unit was opened toward the inner wall surface of the lower part of the main housing (i.e., opened downward). As the fan unit, a fan unit of multiblade fan type with an air flow of 92 CFM was used.

In a test chamber in which sounds from outside were shut off, the noises were measured at three sites in total, i.e., at two sites 1 m apart leftward and rightward from the ceiling mounted ventilation fan with illumination in the horizontal direction and one site 1 m apart downward therefrom.

Results in the ceiling mounted ventilation fan with illumination of the comparative example were 38.9 dB at the left measurement point, 39.4 dB at the right measurement point, and 43.9 dB at the lower measurement point. By contrast, results in the ceiling mounted ventilation fan with illumination of the working example were 36.2 dB at the left measurement point, 36.4 dB at the right measurement point, and 42.9 dB at the lower measurement point.

The results of the measurement indicate that the noises of the ceiling mounted ventilation fan with illumination of the working example were reduced at all the measurement points in comparison with the comparative example and that the noise reduction effect by the working example was greater.

It is to be noted that, by properly combining the arbitrary embodiments of the aforementioned various embodiments, the effects possessed by them can be produced.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

REFERENCE SIGNS LIST

1 ceiling mounted ventilation fan with illumination
2 ceiling
3 ceiling opening
10 main housing
11 first opening
12 second opening
13 duct connection part
14 duct
15 mounting member
16 guiding part
17 guiding bar
18 stopper
20 fan unit
21 fan
22 motor
23 fan casing

24 air inlet
25 air outlet
26 sealing member
27 mounting part
28 leg part
30 lighting equipment
31 lamp
32 lighting cover
32*a* upper end
32 fan unit end
32*c* reflecting surface
33 lamp mounting fixture
34 lid
35 flange
36 biasing member
40 electrical unit
S gap for air intake

The invention claimed is:

1. A ceiling mounted ventilation fan with illumination comprising: a main housing, a fan unit and lighting equipment installed in the main housing, the main housing comprising:

a first opening connected to an air outlet of the fan unit, the first opening communicating with a duct, and a second opening provided in a lower part of the main housing so as to communicate with an interior of a room, the lighting equipment comprising:

an illumination unit, and a lighting cover attached to the main housing and provided in the main housing so as to surround the illumination unit, the lighting cover having a reflecting surface which reflects light from the illumination unit so as to guide the light through the second opening into the room, the fan unit comprising:

a fan, and a fan casing positioned at a first position, spaced, in a horizontal direction, from a second position that is above the second opening, the fan casing surrounding the fan, the fan casing having an air inlet opening directed upwardly, wherein air is introduced through the second opening into the main housing, and the introduced air is sucked through the air inlet of the fan casing into the fan unit and is discharged through the first opening into the duct by the fan unit, and the ceiling mounted ventilation fan further comprising:

a first mounting member fixed on an upper wall of the main housing, and a second mounting member fixed on the fan casing, wherein the first mounting member and the second mounting member are inclined so that respective inclined surfaces of the first mounting member and the second mounting member face toward the second opening, and the fan is fixed to the upper wall of the main housing by fixing the inclined surface of the first mounting member to the inclined surface of the second mounting member.

2. The ceiling mounted ventilation fan with illumination according to claim 1, wherein an electrical unit for the fan unit or the lighting equipment is placed on an area facing the second opening, on an inner surface of the upper wall of the main housing, and the fan unit is provided in the main housing so that a distance L1 from the inner surface of the upper wall of the main housing to the air inlet of the fan casing is greater than a height L2 of the electrical unit.

3. The ceiling mounted ventilation fan with illumination according to claim 2, further comprising legs that support the fan casing on an inner wall surface of the lower part of the main housing, wherein the fan unit is movable between a placement position of the fan unit in the main housing and a maintenance position of the fan unit over the second opening by slide movement of the legs along the inner wall surface of the lower part of the main housing.

4. The ceiling mounted ventilation fan with illumination according to claim 3, further comprising guides that are engaged with the legs so as to guide the slide movement of the legs.

5. The ceiling mounted ventilation fan with illumination according to claim 1, wherein the inclination of the respective inclined surfaces of the first mounting member and the second mounting member is such that a fastening member extending through the first and second mounting members is generally oriented towards a center of the second opening.

6. The ceiling mounted ventilation fan with illumination according to claim 1 wherein a fan motor that drives the fan is provided beneath the fan, the fan motor being supported on a lower wall of the main housing.

7. The ceiling mounted ventilation fan with illumination according to claim 1, wherein a lowermost extent of the fan casing is positioned, vertically, intermediate the vertical extent of the lighting cover.

8. The ceiling mounted ventilation fan with illumination according to claim 1, wherein the first opening is provided in a wall of the main housing that extends transverse to a direction in which the lighting equipment and fan unit are spaced from each other.

9. The ceiling mounted ventilation fan with illumination according to claim 1, wherein the lamp is vertically aligned with the second opening.

10. A ceiling mounted ventilation fan with illumination comprising:

a fan unit, an illumination unit, a main housing in which the fan unit and the illumination unit are installed, the main housing having a first opening connected to an air outlet of the fan unit and communicating with a duct, and a second opening provided in a lower part of the main housing so as to communicate with an interior of a room, and a cylindrical member having a shape of a circular truncated conical cylinder or polygonal truncated prismoidal cylinder such that a size of lower end of the cylindrical member is greater than a size of an upper end of the cylindrical member, the cylindrical member being attached to the main housing so as to surround the illumination unit, the fan unit comprising:

a fan, and a fan casing positioned at a first position space, in a horizontal direction, from a second position that is above the second opening, the fan casing surrounding the fan, the fan casing having an air inlet opening directed upwardly, wherein light from the illumination unit passes through the second opening of the main housing into the room, and air is introduced through the second opening into the main housing and the introduced air is sucked through the air inlet of the fan casing into the fan unit and is discharged through the first opening into the duct by the fan unit, and the ceiling mounted ventilation fan further comprising:

a first mounting member fixed on an upper wall of the main housing, and a second mounting member fixed on the fan casing, wherein the first mounting member and the second mounting member are inclined so that respective inclined surfaces of the first mounting member and the second mounting member face to the second opening, and the fan is fixed to the upper wall of the main housing by fixing the inclined surface of the first mounting member to the inclined surface of the second mounting member.

11. The ceiling mounted ventilation fan with illumination according to claim 10, wherein an electrical unit for the fan unit or the illumination unit is placed on an area facing the second opening, on an inner surface of the upper wall of the main housing, and the fan unit is provided in the main housing so that a distance L1 from the inner wall surface of the upper wall of the main housing to the air inlet of the fan casing is greater than a height L2 of the electrical unit.

12. The ceiling mounted ventilation fan with illumination according to claim 11, further comprising legs that support the fan casing on an inner wall surface of the lower part of the main housing, wherein the fan unit is movable between a placement position of the fan unit in the main housing and a maintenance position of the fan unit over the second opening by slide movement of the legs along the inner wall surface of the lower part of the main housing.

13. The ceiling mounted ventilation fan with illumination according to claim 12, further comprising guides that are engaged with the legs so as to guide the slide movement of the legs.

14. The ceiling mounted ventilation fan with illumination according to claim 10, wherein the inclination of the respective inclined surfaces of the first mounting member and the second mounting member is such that a fastening member extending through the first and second mounting members is generally oriented towards a center of the second opening.

15. The ceiling mounted ventilation fan with illumination according to claim 10, wherein a fan motor that drives the fan is provided beneath the fan, the fan motor being supported on a lower wall of the main housing.

16. The ceiling mounted ventilation fan with illumination according to claim 10, wherein a lowermost extent of the fan casing is positioned, vertically, intermediate to vertical extent of the lighting cover.

17. The ceiling mounted ventilation fan with illumination according to claim 10, wherein the first opening is provided in a wall of the main housing that extends transverse to a direction in which the lighting equipment and the fan unit are spaced from each other.

18. The ceiling mounted ventilation fan with illumination according to claim 10, wherein the lamp is vertically aligned with the second opening.

* * * * *